US007779984B2

(12) United States Patent
Martin et al.

(10) Patent No.: US 7,779,984 B2
(45) Date of Patent: Aug. 24, 2010

(54) ARRANGEMENT FOR EXTRACTING EXTRACTION PRODUCTS IN UNDERGROUND EXTRACTION OPERATIONS IN CAVING

(75) Inventors: Harry Martin, Cranberry Township, PA (US); Juan Delgado, Eagle Pass, TX (US); Victor Raúl Encina Montenegro, Providencia/Santiago (CL); Pablo Antonio Letelier Parga, Providencia/Santiago (CL); Jaime Hernán Carreño Valdés, El Salvador (CL); Fernando Arturo Geister Bühlmann, Buin-Region Metropolitana (CL); Detlef Hahn, Lunen (DE); Jens Steinberg, Hattingen (DE); Hans Peter Lanz, Santiago (CL); Frank Herrmann, Chemnitz (DE); Hans Tümpner, Aue (DE); Reinhold Brüggemann, Dortmund (DE); Ulrich Pasehedus, legal representative, Ascheberg (DE)

(73) Assignees: Bucyrus DBT Europe GmbH, Lünen (DE); Corporacion Nacional Del Cobre De Chile (Codelco), Santiago (CL)

( * ) Notice: Subject to any disclaimer, the term of this patent is extended or adjusted under 35 U.S.C. 154(b) by 205 days.

(21) Appl. No.: 11/991,367

(22) PCT Filed: Aug. 24, 2006

(86) PCT No.: PCT/EP2006/008303

§ 371 (c)(1),
(2), (4) Date: May 6, 2008

(87) PCT Pub. No.: WO2007/028503

PCT Pub. Date: Mar. 15, 2007

(65) Prior Publication Data

US 2009/0255783 A1 Oct. 15, 2009

(30) Foreign Application Priority Data

Sep. 9, 2005 (DE) ..... 10 2005 043 236

(51) Int. Cl.
*B65G 65/14* (2006.01)

(52) U.S. Cl. ..... 198/308.1; 198/309; 198/463.2; 299/18

(58) Field of Classification Search ..... 198/308.1, 198/309, 312, 463.2, 468.11; 299/13, 18, 299/19

See application file for complete search history.

(56) References Cited

U.S. PATENT DOCUMENTS 2,195,544 A * 4/1940 Stahl et al. ..... 299/18

(Continued)

FOREIGN PATENT DOCUMENTS

GB 634832 3/1950

(Continued)

OTHER PUBLICATIONS

International Search Report for PCT/EP2006/008303, Jan. 2007.

*Primary Examiner*—James R Bidwell
(74) *Attorney, Agent, or Firm*—Rankin, Hill & Clark LLP

(57) ABSTRACT

An arrangement for extracting extraction products in caving in which the extraction product is extracted downwards through an extraction funnel into an extraction path and from this is transferred onto an extraction conveyor arranged in a conveyor path, in which arrangement the extraction path extends transversely between the conveyor path and an auxiliary path parallel to this, a loading ramp is arranged in the extraction path which forms a ramp surface orientated transversely to the conveying direction of the extraction conveyor and inclined towards it. The extraction path is provided with a rail guidance attached to the bottom and extending in the area between the auxiliary path and the conveying path, on which the loading ramp is guided and along which it can be moved by a displacement drive (20) in the direction of the conveyor path and in the opposite direction.

21 Claims, 3 Drawing Sheets

U.S. PATENT DOCUMENTS

| | | | | |
|---|---|---|---|---|
| 2,805,761 | A | 9/1957 | Stroh et al. | |
| 4,139,087 | A * | 2/1979 | Westhoff et al. | 198/309 |
| 4,353,796 | A * | 10/1982 | Kubo et al. | 299/18 |
| 4,377,310 | A | 3/1983 | Gubin et al. | |
| 7,350,874 | B2 * | 4/2008 | Bruggemann et al. | 299/18 |

FOREIGN PATENT DOCUMENTS

| | | |
|---|---|---|
| GB | 654868 | 7/1951 |
| WO | WO 2005/001245 | 1/2005 |

* cited by examiner

ARRANGEMENT FOR EXTRACTING EXTRACTION PRODUCTS IN UNDERGROUND EXTRACTION OPERATIONS IN CAVING

The invention relates to an arrangement for extracting extraction products in underground mining in caving, in which the extraction product after breaking through in an extraction face can be removed by means of at least one extraction funnel or similar, arranged in the bottom rock of the extraction face and open to an extraction path developed underneath the face, whereas the extraction path extends transversely between a conveyor path having an extraction conveyor for the extracted extraction product and an auxiliary path running parallel thereto and having a loading ramp with a ramp surface essentially transverse to the direction of extraction of the extraction conveyor and inclined thereto.

BACKGROUND OF INVENTION

Arrangements for extracting extraction products are known as is shown in WO 2005/001245 A2 which is incorporated by reference herein as background material. The known device has proven to be suitable for extracting extraction products extracted in caving, but there are occasional problems when the particle size of the extracted extraction product reaching the loading ramp via the extraction funnel changes, as when the extraction product becoming finer in particle size it can suddenly occur that the extraction path becomes blocked up to the ceiling height of the extraction path through material sliding through the extraction funnel too quickly, while unexpectedly large chunks of rock become jammed between the loading ramp and the lower edge of the extraction funnel thereby hindering or entirely preventing the flow of the following material. In the known arrangement, in such cases the extraction path and/or the extraction funnel have to be cleared by hand, i.e. manually by miners, which not only involves heavy work for them but is also time-consuming and dangerous.

STATEMENT OF INVENTION

In accordance with the present invention, an arrangement for extracting extraction products in underground mining in caving is provided in which the extraction product after caving in an extraction face can be removed through at least one extraction funnel or the like being arranged in the bottom rock of the extraction face and open to an extraction path developed underneath the face.

In this respect, provided is an extraction arrangement in which the extraction path extends transversely to a conveyor path having an extraction conveyor for the extracted extraction product and having a loading ramp with a ramp surface essentially transverse to the direction of extraction of the extraction conveyor and inclined thereto. The arrangement further including an extraction path with a loading ramp that is guided such that it is movable by a displacement drive system toward and away from the conveyor path.

It is the object of the invention to improve the known device so that in the event of blockages by extraction material the extraction path can be rapidly, reliably and safely cleared again, and to create a possibility of regulating the quantity of extraction product passing through the extraction funnel.

This object is achieved with the invention in that the extraction path is provided with a rail guidance firmly arranged on the bottom extending in the area between the auxiliary path and conveying path and on which the loading ramp is guided and along which it can be moved by means of a displacement drive towards the extraction path and in the opposite direction.

With this arrangement it is possible to move the entire loading ramp in the extraction path towards the conveying path and in the opposite direction. By moving the loading ramp in the direction of the conveying path/the conveyor arranged therein, the extraction material located in and possibly blocking the extraction path in front of the loading ramp is pushed out of the extraction path onto the conveyor, while at the same time the loading ramp closes the passage of the extraction funnel into the extraction path more and more due to its advancing movement so that less and less material can subsequently flow through and the extraction funnel can eventually even be closed off. Vice-versa the passage of the extraction funnel can be increasingly opened by retracting the loading ramp along the guide rail so that rock that has jammed in the gap between the ramp surface of the loading ramp and the lower opening of the extraction funnel preventing the further flow of material, is released again and can proceed in the direction of the conveyor. In a particularly elegant manner the invention therefore permits control of the extraction material extraction as well as the extraction path to be kept clear as the loading ramp itself is movable under the extraction funnel as a type of sliding controller.

Preferably the displacement drive comprises a hydraulic shifting cylinder device which is supported on the one hand on the loading ramp and on the other hand on the rail guidance. With a hydraulic shifting cylinder device of this type the loading ramp can be moved sensitively and at the same time with great force and brought into the required position while the extraction products both on or in front of the loading ramp are carried with it without problems and pushed onto the conveyor in the conveyor path.

In a particularly advantageous manner the rail guidance has a number of connection points for the shifting cylinder device to which the latter can be optionally connected. In this way it is possible even with a comparatively small stroke of the shifting cylinder device to make the loading ramp travel over a large overall path in that on achieving the maximum (or minimum) stroke the shifting cylinder device is released from the currently used connection point on the rail guidance, the cylinder(s) is/are then extended/retracted and the shifting cylinder device is then connected to another connection point on the rail guidance from which further movement of the loading ramp in the already previously started direction can take place. Here it has proven to be particularly advantageous if the connection points are designed as a type of ratchet system along which the shifting cylinder device after releasing one of the locking devices assigned to it can be moved in a locking manner and is lockable in various positions. The locking device is expediently such that in one of the two directions of movement of the loading ramp it is moved by the cylinders of the shifting cylinder device in an unhindered manner along the rail guidance and its ratchet system, but in the opposite direction locks and then forms an abutment for the shifting cylinder device so that it can continue pushing the loading ramp by the available stroke length. It is self-evident that the direction of action of the ratchet system and/or that of the locking device interacting with it is reversible.

It is possible for the shifting cylinder device to be provided with a device for extending the stroke length. This can essentially consist of spacers arranged to swing in and out between the locking device and the shifting cylinders of the shifting cylinder device. With such an extension it is possible to move the loading ramp without problem from the auxiliary path to the conveying path.

It is also advantageous if the extraction path, in the area in front of the extraction funnel orientated towards the auxiliary path is equipped with a securing frame surrounding the loading ramp at the sides and at the top which in a particularly preferred embodiment of the invention essentially consists of concrete. The securing frame stabilises the often crumbling area of the top wall next to the edge of the extraction funnel orientated towards the auxiliary path so that this edge cannot break out in this area, which could otherwise lead to extracted rock not going in the direction of the conveying path but ending up in the auxiliary path. Furthermore, the securing frame forms a guide frame for the loading ramp in that it surrounds the latter closely and in a guiding manner at the sides and on its top. In connection with this it is also expedient if the loading ramp is provided with lateral protective cladding whereas the securing frame forms an opening the dimensions of which are matched to the width and height of the protective cladding of the loading ramp. The loading ramp then moves through the opening in a manner similar to a piston in a cylinder.

It is advantageous if the rail guidance has two individual rails arranged in parallel next to each other on the insides of which facing each other the ratchet teeth forming the ratchet system are arranged. By way of the symmetrical arrangement an even distribution of forces and stressing of the components involved in the moving process is achieved and through the arrangement of the ratchet teeth on the inner sides of the rails they are largely protected against damage.

The individual rails can be supported on sleepers, more particularly steel sleepers, concreted in on the bottom, so that the rails are arranged to form a fixed track not only guaranteeing exact guiding of the loading ramp but also securely taking up the thrust forces exerted thereby.

In a known manner the loading ramp can have a clearing cylinder arrangement with one or more clearing cylinders conveying in the direction of the extraction conveyor. This can have a sliding shield which can preferably be advanced in the direction of the conveyor path by means of the clearing cylinder(s).

On its upper side the loading ramp preferably forms a closing surface with which it can largely be brought under the extraction funnel closing it off.

Other features and advantages of the invention are set out in the following description and the drawing in which a preferred form of embodiment of the invention is explained in more detail by way of an example.

DESCRIPTION OF PREFERRED EMBIDIMENTS

Figure 1:
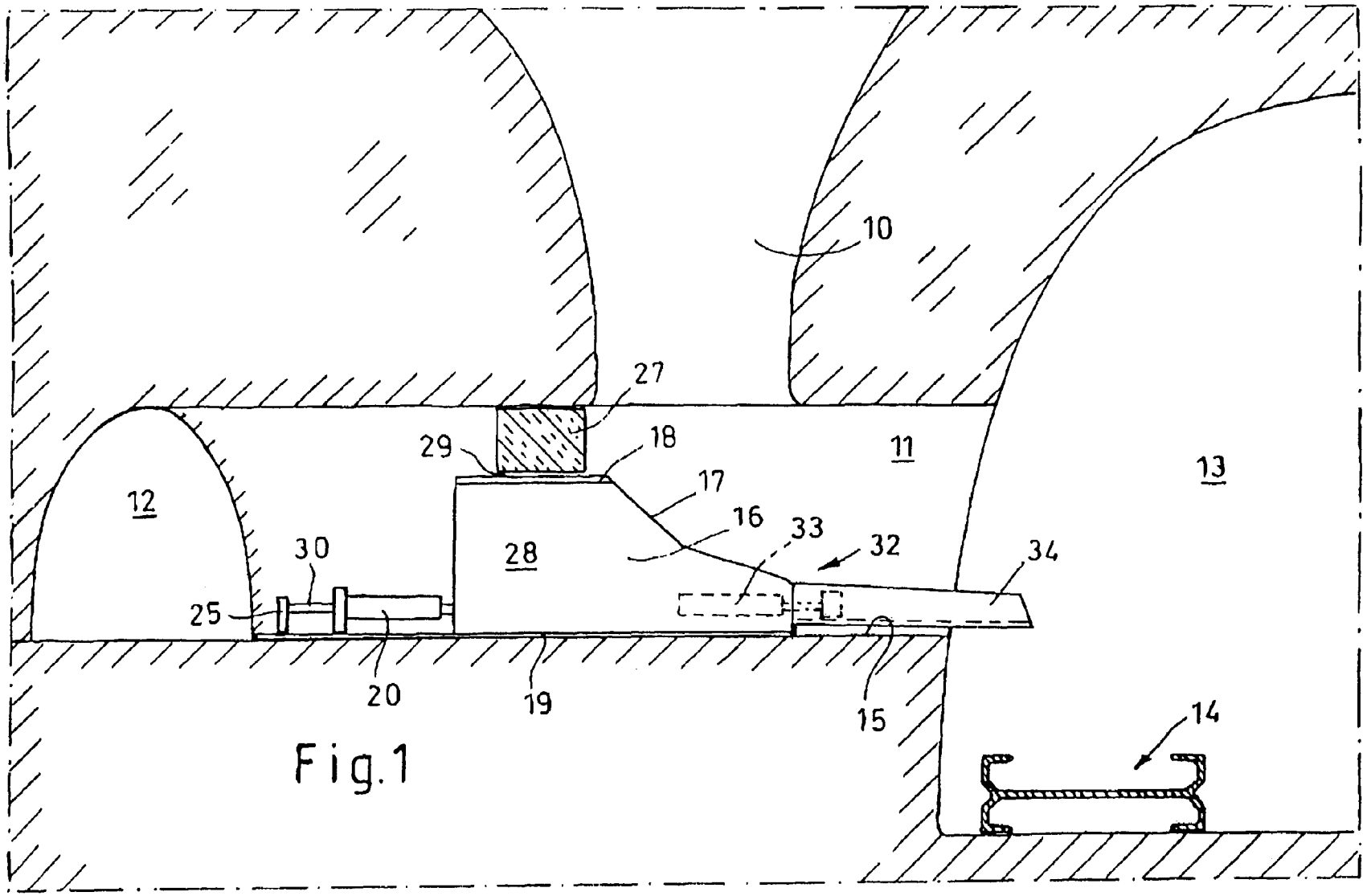
FIG. 1 shows an arrangement in accordance with the invention for extracting copper ore in underground caving in cross-section through the extraction path.

With the arrangement in accordance with the invention copper ore is extracted in caving, which breaks through an extraction face (not shown) arranged above an extraction funnel 10 and is then extracted through the extraction funnel 10 into an extraction path 11 located beneath it. The extraction path 11 runs transversely to an auxiliary path 12 and a conveying path 13 in which a chain scraper conveyor 14 for removing the extraction products is arranged. The transverse extraction path 11 is accessible from the auxiliary path 12. The bottom of the conveyor path 13 and the chain scraper conveyor arranged thereon are below the level of the bottom 15 of the extraction path so that the extraction path 11 opens into the conveyor path above the conveyor and the extraction products can fall from above onto the conveyor.

In order to transfer the extraction product which is removed from the extraction funnel and enters the extraction path onto the conveyor in the conveying path, in the extraction path there is a loading ramp 16 with a ramp surface 17 essentially transverse to the conveying direction of the chain scraper conveyor 14 and inclined towards it, which diverts the rock falling into the extraction path through the funnel 10 and directs it to the conveyor. In its rear section facing the auxiliary path 12 the loading ramp 16 has an essentially flat upper roof surface 18 which adjoins the upper end of the inclined ramp surface 17.

The entire loading ramp 16 is moveably arranged in the extraction path transversely to the conveying direction of the chain scraper conveyor. To this end the extraction path has a firmly arranged rail guidance 19 on the bottom 15 extending in the area between the auxiliary path 12 and the conveying path 13 and on which the loading ramp 16 is guided. To move the loading ramp in the direction of the conveyor path or in the opposite direction a displacement drive 20 is provided which comprises a shifting cylinder arrangement supported on the one hand at the loading ramp 16 and on the other hand at the rail guidance 19. As can best be seen in FIG. 2, the rail guidance has two individual rails 21, 22 arranged in parallel next to each other and welded onto steel sleeper elements 23. In turn the sleeper elements 23 are firmly embedded in concrete into the bottom 15 of the extraction path 11.

On the inner sides 21*a*, 22*a* facing each other the individual rails 21, 22 are provided with a number of connection points in the form of ratchet teeth 24 arranged one after the other in the longitudinal direction of the rails to which the shifting cylinder device 20 provided with a locking device 25 can be connected. The connection points 24 form a ratchet system along which the locking device 25 of the shifting cylinder device 20 is movable in an interlocking manner and can therefore be locked in various positions on the rails of the rail guidance. The shifting cylinders 26 of the displacement drive 20 are supported on the one hand on the loading ramp and on the other hand on the locking device 25 and in the locked position of the locking device can move the loading ramp 16 forwards and backwards along the rail guidance 19 by extending and retracting loading ramp. When the locking device is unlocked the loading ramp retains its position in the extraction path when the shifting cylinders are retracted and extended so that the locking device of the displacement drive can be moved to another locking position on the rail guidance and locked there. In this way, despite the limited displacement path of the shifting cylinders, the loading ramp 16 can be moved along a very long way in the extraction path and at one extreme can be moved close to the auxiliary path 12 so that the extraction funnel 10 opening into the extraction path is completely free, and at the other extreme the loading ramp can be moved so far towards the conveying path 13 that its roof surface 18 practically covers the extraction funnel at the bottom, thereby largely closing off extraction.

It can be seen in FIG. 1 that the extraction path in the area orientated toward the auxiliary path 12 before the extraction funnel 10 is provided with a securing frame 27, surrounding the loading ramp 16 at the sides and at the top thereof, which securing frame in the illustrated embodiment is made of concrete, but which can also be a steel structure. The loading ramp on its outer sides laterally adjoining the roof surface 18 is provided with a lateral protective cladding 28 and the securing frame 27 forms an opening the dimensions of which are matched to the width and height of the loading ramp which are defined by the protective cladding and the roof surface. The loading ramp is moved through the securing frame in a manner comparable with a piston in a cylinder and the arrangement ensures that no rock entering the extraction path through the funnel 10 can reach the auxiliary path 12 as the opening 29 in the securing frame is basically completely filled by the loading ramp 16 and is thus closed in the same way as with a plug.

Figure 2:
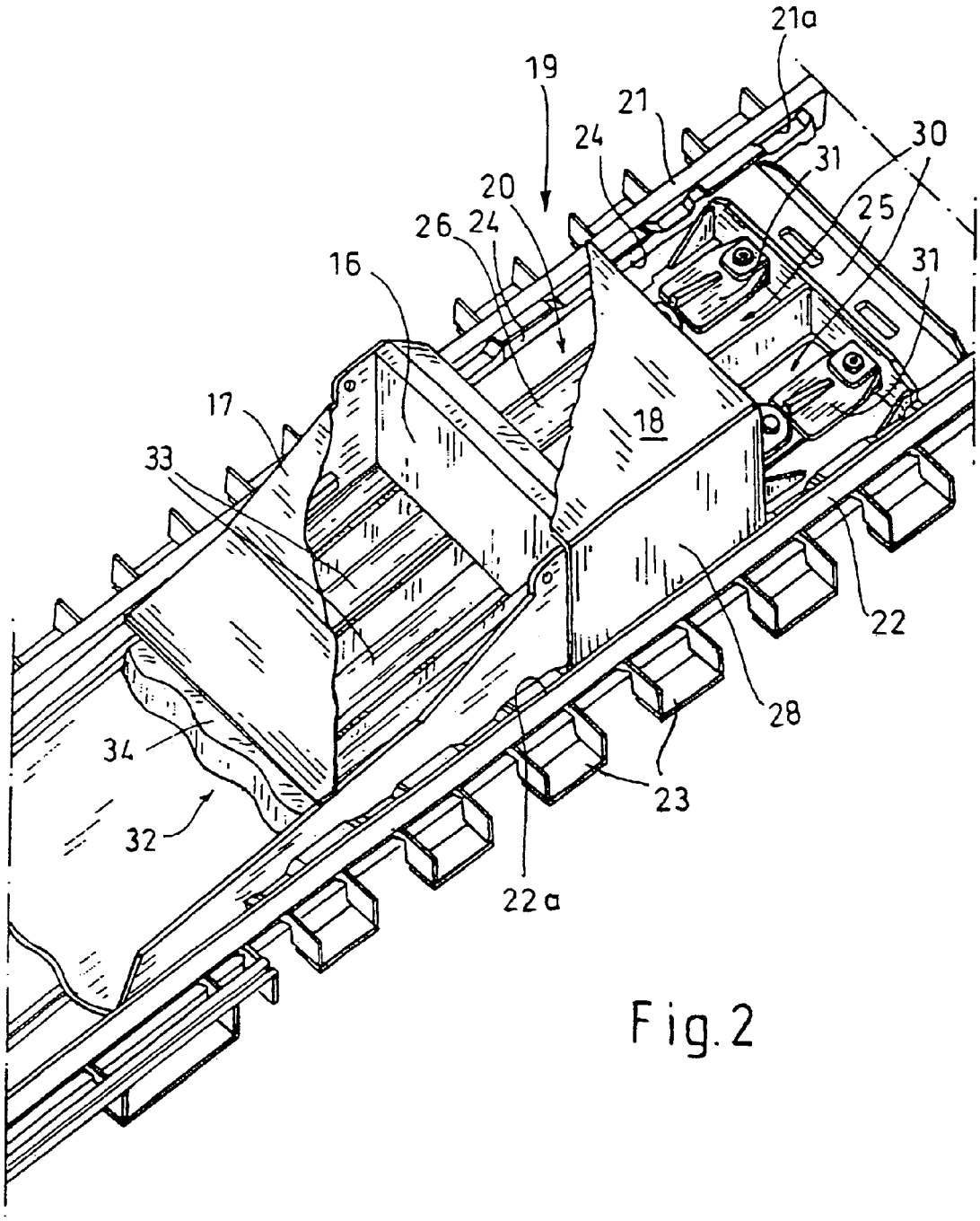
FIG. 2 shows a perspective view obliquely from above of the rail guidance of the arrangement in accordance with FIG. 1 with the loading ramp guided thereon.
Figure 3:
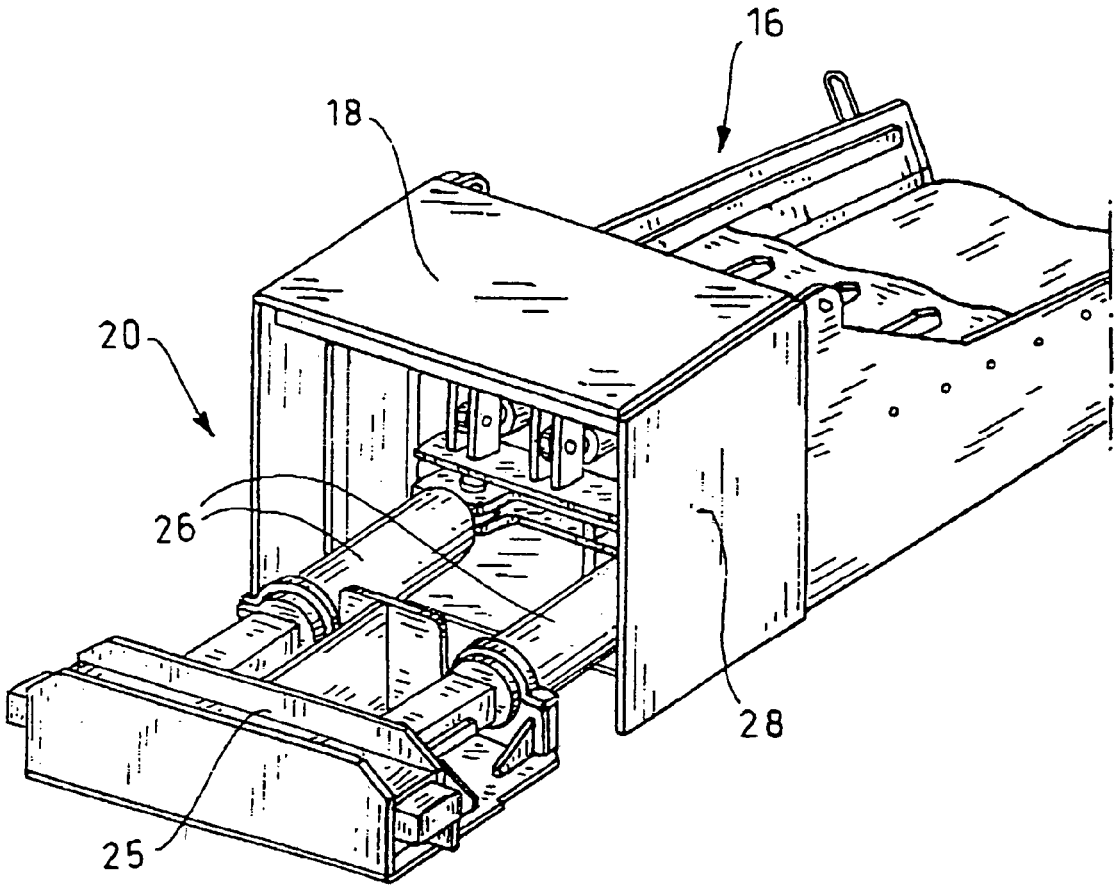
FIG. 3 shows the loading ramp of the arrangement in accordance with FIG. 1 in a perspective view obliquely from behind.

FIG. 2 shows that the shifting cylinder device 20 is provided with a device for extending the stroke length of the shifting cylinders 26. The device for extending the stroke length essentially comprises spacers 31 assigned to the shifting cylinders which are arranged in a pivoting manner on the locking device 25 and can be swung in and out between the locking device and the shifting cylinders so that the stops of the shifting cylinders can be adjusted a little further.

As the drawing also shows, the loading ramp at its front facing the conveyor path is provided with a clearing cylinder device 32 with several clearing cylinders 33 which operate a sliding shield 34 and move this towards the conveyor path in order to transfer rock to the conveyer which rock has collected on the bottom 15 of the extraction path 11 and does fall by itself onto the conveyer.

If can be seen that with the arrangement according to the invention it is possible to move the entire loading ramp over a very large distance in the extraction path and thereby on the one hand to change the size of the funnel outlet or even to close it fully in that the roof surface 18 of the loading ramp is brought partially or fully under the funnel outlet. Furthermore, by moving the entire loading ramp the extraction path 11 can be simply cleared of extracted material that has collected in front of the mouth of the extraction path in the conveyor path and is thereby hindering the flow of further material through the extraction funnel. The rear of the loading ramp is easily accessible from the auxiliary path as are the shifting cylinders ensuring its movability and the rail guidance along which it is moved.

While considerable emphasis has been placed on the preferred embodiments of the invention illustrated and described herein, it will be appreciated that other embodiments and/or equivalents thereof can be made and that many changes can be made in the preferred embodiments without departing from the principles of the invention. Accordingly, it is to be distinctly understood that the foregoing descriptive matter is to be interpreted merely as illustrative of the invention and not as a limitation.

The invention claimed is:

1. An arrangement for extracting extraction products in underground mining in caving, in which the extraction product after caving in an extraction face can be removed through at least one extraction funnel being arranged in the bottom rock of the extraction face and open to an extraction path developed underneath the face, whereas the extraction path extends transversely between a conveyor path having an extraction conveyor for the extracted extraction product and an auxiliary path running parallel thereto, the arrangement comprising a loading ramp with a ramp surface essentially transverse to the direction of extraction of the extraction conveyor and inclined thereto, the extraction path being provided with a rail guidance, firmly arranged on a bottom surface which extends in the area between the auxiliary path and the conveyor path and on which the loading ramp is guided and along which it is movable by a displacement drive in the direction of the conveyor and in the opposite direction, wherein the displacement drive comprises a shifting cylinder device supported at the loading ramp and the rail guidance, and wherein the rail guidance has a number of connection points for the shifting cylinder device such that the shifting cylinder is selectively connectable to any one of the connection points.

2. The arrangement in accordance with claim 1, wherein the connection points are designed as a ratchet system along which the shifting cylinder device after loosening of a locking device assigned thereto can be moved in an engaging manner and can be locked in various positions.

3. The arrangement in accordance with claim 1, wherein the shifting cylinder device is provided with a stroke lengthening device for extending the stroke length.

4. The arrangement in accordance with claim 3, wherein the shifting cylinder is selectively connectable to any one of the connection points and the connection points are designed as a ratchet system along which the shifting cylinder device after loosening of a locking device assigned thereto can be moved in an engaging manner and can be locked in various positions, the stroke lengthening device comprising spacers which are arranged to swing in and out between the locking device and the shifting cylinders of the shifting cylinder device.

5. The arrangement in accordance with claim 1, further including a securing frame, the securing frame being positioned in front of the extraction funnel and in the extraction path in the area orientated towards the auxiliary path, the securing frame enclosing the loading ramp at the sides and at the top.

6. The arrangement in accordance with claim 5, wherein the securing frame is essentially made of concrete.

7. The arrangement in accordance with claim 1, wherein the loading ramp is provided with a protective cladding at the sides.

8. The arrangement in accordance with claim 7, further including a securing frame, the securing frame being positioned in front of the extraction funnel and in the extraction path in the area orientated towards the auxiliary path, the securing frame enclosing the loading ramp at the sides and at the top, the securing frame forms an opening the dimensions of which are matched to the width and height of the protective cladding of the loading ramp.

9. The arrangement in accordance with claim 2 wherein the rail guidance has two individual rails arranged in parallel next to each other and each having an inner side which are facing each other, the inner sides including ratchet teeth forming a portion of the ratchet system.

10. The arrangement in accordance with claim 9, wherein the individual rails are supported on sleepers which are secured relative to the bottom.

11. An arrangement for extracting extraction products in underground mining in caving, in which the extraction product after caving in an extraction face can be removed through at least one extraction funnel being arranged in the bottom rock of the extraction face and open to an extraction path developed underneath the face, whereas the extraction path extends transversely between a conveyor path having an extraction conveyor for the extracted extraction product and an auxiliary path running parallel thereto, the arrangement comprising a loading ramp with a ramp surface essentially transverse to the direction of extraction of the extraction conveyor and inclined thereto, the extraction path being provided with a rail guidance, firmly arranged on a bottom surface which extends in the area between the auxiliary path and the conveyor path and on which the loading ramp is guided and along which it is movable by a displacement drive in the direction of the conveyor and in the opposite direction, wherein the loading ramp comprises a clearing cylinder device with one or more clearing cylinders conveying in the direction of the extraction conveyor.

12. The arrangement in accordance with claim 11, wherein the clearing device comprises a sliding shield.

13. The arrangement in accordance with claim 12, wherein the sliding shield can be moved in the direction of the conveyor path by means of the clearing cylinder(s).

14. An arrangement for extracting extraction products in underground mining in caving, in which the extraction product after caving in an extraction face can be removed through at least one extraction funnel being arranged in the bottom rock of the extraction face and open to an extraction path developed underneath the face, whereas the extraction path extends transversely between a conveyor path having an extraction conveyor for the extracted extraction product and an auxiliary path running parallel thereto, the arrangement comprising a loading ramp with a ramp surface essentially transverse to the direction of extraction of the extraction conveyor and inclined thereto, the extraction path being provided with a rail guidance, firmly arranged on a bottom surface which extends in the area between the auxiliary path and the conveyor path and on which the loading ramp is guided and along which it is movable by a displacement drive in the direction of the conveyor and in the opposite direction, wherein the loading ramp forms a closing surface on its upper side with which it can be largely brought beneath the extraction funnel to close off the extraction funnel.

15. An arrangement for extracting extraction products in underground mining in caving, in which the extraction product after caving in an extraction face can be removed through of at least one extraction funnel being arranged in the bottom rock of the extraction face and open to an extraction path developed underneath the face, whereas the extraction path extends transversely of a conveyor path in a transverse direction, the arrangement comprising a loading ramp with a ramp surface essentially transverse to the direction of extraction of the extraction conveyor and inclined thereto and a securing frame, the loading ramp being positioned in the extraction path and being mounted to a moveable ramp frame such that the loading ramp and the ramp surface are selectively moveable in the transverse direction relative to the at least one extraction funnel, the selective movement being driven by a displacement drive which is in engagement between the ramp frame and a rail system fixed relative to the extraction path, the securing frame being positioned in front of the extraction funnel and in the extraction path in the area orientated towards the auxiliary path, the securing frame enclosing the loading ramp at the sides and at the top.

16. The arrangement in accordance with claim 15, wherein the rail system is a rail guidance system comprising a pair of parallel rails fixed relative to extraction path, the displacement drive comprising an actuating cylinder device extending between the ramp frame and the rail guidance system.

17. The arrangement in accordance with claim 16, wherein the pair of rails includes a plurality of connection points, the actuating cylinder being selectively connectable to any one of the plurality of connection points.

18. The arrangement in accordance with claim 15 wherein the loading ramp further includes at least one of a protective cladding at the sides and a closing surface on its upper side, the closing surface being configured to at least partially close off the extraction funnel when the loading ramp is moved in the transverse direction such that the closing surface is positioned beneath the extraction funnel.

19. The arrangement in accordance with claim 15 wherein the loading ramp further includes a clearing cylinder device with at least one clearing cylinder joined between the ramp frame and the cylinder device such that the cylinder device moves relative to the frame in the transverse direction.

20. The arrangement in accordance with claim 19, wherein the clearing device further includes a sliding shield fixed relative to the clearing device.

21. An arrangement for extracting extraction products in underground mining in caving, in which the extraction product after caving in an extraction face can be removed through at least one extraction funnel being arranged in the bottom rock of the extraction face and open to an extraction path developed underneath the face, whereas the extraction path extends transversely of a conveyor path in a transverse direction, the arrangement comprising a loading ramp with a ramp surface essentially transverse to the direction of extraction of the extraction conveyor and inclined thereto, the loading ramp being positioned in the extraction path and being mounted to a moveable ramp frame such that the loading ramp and the ramp surface are selectively moveable in the transverse direction relative to the at least one extraction funnel, the selective movement being driven by a displacement drive which is in engagement between the ramp frame and a rail system fixed relative to the extraction path, wherein the loading ramp further includes at least one of a protective cladding at the sides and a closing surface on its upper side, the closing surface being configured to at least partially close off the extraction funnel when the loading ramp is moved in the transverse direction such that the closing surface is positioned beneath the extraction funnel.

* * * * *